US006817806B1

(12) United States Patent
Arellanes

(10) Patent No.: US 6,817,806 B1
(45) Date of Patent: Nov. 16, 2004

(54) FLUENT MATERIAL CONFINEMENT SYSTEM

(76) Inventor: Al M. Arellanes, 1983 San Luis Ave. #21, Mountain View, CA (US) 94043

( * ) Notice: Subject to any disclaimer, the term of this patent is extended or adjusted under 35 U.S.C. 154(b) by 0 days.

(21) Appl. No.: 10/633,297

(22) Filed: Jul. 31, 2003

Related U.S. Application Data

(63) Continuation of application No. 10/086,772, filed on Feb. 28, 2002, now abandoned.
(60) Provisional application No. 60/274,738, filed on Mar. 9, 2001, and provisional application No. 60/272,128, filed on Feb. 28, 2001.

(51) Int. Cl.[7] ..... E02B 7/02; E04C 2/42
(52) U.S. Cl. ..... 405/114; 405/111; 405/116; 52/668; 428/12
(58) Field of Search ..... 405/107, 109, 405/111, 114–117; 404/18, 28, 34, 35, 41–46; 52/666, 668, 105, 125.2, 125.3; 446/124, 487, 488; 428/12, 53

(56) References Cited

U.S. PATENT DOCUMENTS

| | | | | |
|---|---|---|---|---|
| 1,081,476 | A | 12/1913 | Wellen | 52/662 |
| 1,896,957 | A | 2/1933 | Hutcheson | 52/667 |
| 2,069,391 | A | 2/1937 | Sample | 52/668 |
| 2,121,173 | A | 6/1938 | Macpherson | 47/33 |
| 2,205,758 | A | 6/1940 | Clark | 210/99 |
| 2,315,448 | A | 3/1943 | Nagin et al. | 404/36 |
| 3,050,162 | A | 8/1962 | Zingone | 52/666 |
| 3,616,111 | A | 10/1971 | Raech, Jr. | 428/52 |
| 3,762,124 | A | 10/1973 | De Jonge | 52/666 |
| 3,807,116 | A | 4/1974 | Flynn | 52/793.11 |
| 3,878,638 | A | 4/1975 | Benjamin | 446/488 |
| 4,005,943 | A | 2/1977 | Devenish et al. | 404/41 |
| 4,168,924 | A | 9/1979 | Draper et al. | 404/70 |
| 4,288,175 | A | 9/1981 | Baker et al. | 405/117 |
| 4,358,047 | A | 11/1982 | Raubenheimer | 229/120.36 |
| 4,372,086 | A | 2/1983 | Hanlon | 160/135 |
| 4,384,810 | A | 5/1983 | Neumann | 405/284 |
| 4,448,571 | A | 5/1984 | Eckels | 405/284 |
| 4,452,025 | A | 6/1984 | Lew | 52/668 |
| 4,502,815 | A | 3/1985 | Scales et al. | 405/17 |
| 4,555,201 | A | 11/1985 | Paoluccio | 405/117 |
| 4,572,705 | A | 2/1986 | Vignon et al. | 405/16 |
| 4,785,604 | A | 11/1988 | Johnson, Jr. | 52/668 |
| 4,797,026 | A | 1/1989 | Webster | 404/28 |

(List continued on next page.)

FOREIGN PATENT DOCUMENTS

| | | |
|---|---|---|
| DE | 127104 | 11/1900 |
| DE | 660199 | 4/1938 |
| EP | 0 039 448 | 4/1981 |
| EP | 0 048 006 | 9/1981 |
| FR | 1244800 | 9/1960 |
| NL | 6708323 | 12/1967 |
| WO | WO 84/02913 | 8/1984 |

OTHER PUBLICATIONS

"Investigation of Construction Concepts for Pavements Across Soft Ground," Webster et al., 1978.

(List continued on next page.)

*Primary Examiner*—Robert E. Pezzuto
*Assistant Examiner*—Tara L. Mayo
(74) *Attorney, Agent, or Firm*—Kolisch Hartwell, P.C.

(57) ABSTRACT

A collapsible fluent material confinement system configured to receive a granular fluent material to form a temporary barrier structure. The fluent material confinement system includes a plurality of strips coupled to on another to form an array of collapsible cells, wherein the array of collapsible cell is configured to be movable between a collapsed configuration and an open configuration. The fluent material confinement system also includes a deployment indicator disposed on a selected strip, wherein the deployment indicator is configured to be effective in low visibility conditions to indicate user how to move the grid from the collapsed configuration to the open configuration.

17 Claims, 7 Drawing Sheets

U.S. PATENT DOCUMENTS

| | | | | |
|---|---|---|---|---|
| 4,945,689 | A | 8/1990 | Johnson, Jr. | 52/668 |
| 5,076,546 | A | 12/1991 | Henry | 256/24 |
| 5,250,340 | A | 10/1993 | Bohnhoff | 428/99 |
| 5,604,949 | A | 2/1997 | Mangone | 14/73 |
| 5,806,121 | A | 9/1998 | Mangone | 14/73 |
| 5,864,910 | A | 2/1999 | Mangone | 14/73 |
| 6,390,154 | B1 | 5/2002 | Hall | 141/314 |

OTHER PUBLICATIONS

"Analysis of Grid Cell Reinforced Pavement Bases," Mitchell, 1979.

"Investigation of Beach Sand Trafficability Enhancement Using Sand–Grid Confinement and Membrane Reinforcement Concepts; Report 1: Sand Test Sections 1 and 2," Webster, 1979.

"Investigation of Beach Sand Trafficability Enhancement Using Sand–Grid Confinement and Membrane Reinforcement Concepts; Report 1: Sand Test Sections 3 and 4," Webster, Feb. 1981.

"Experiments in Mouridah and Kalumba for Stabilizing Clayey and Dune Sands Used in Structural Layers," Cella et al., Oct. 1982.

"Development and Preliminary Evaluation of a Rapid Deployment Fortification Wall," Arellanes et al., Dec. 1, 1985.

"The Protection and Rehabilitation of Dams Using Cellular Confinement Systems," Crowe et al., Aug. 1995.

"Expedient Field Fortifications Using Sand–Grid Construction," Hayes, Oct. 1998.

FLUENT MATERIAL CONFINEMENT SYSTEM

CROSS-REFERENCE TO RELATED APPLICATION

This application is a continuation of U.S. patent application Ser. No. 10/086,772, filed Feb. 28, 2002, now abandoned, which claims priority from U.S. Provisional Patent Applications Ser. No. 60/272,128, filed on Feb. 28, 2001, and Ser. No. 60/274,738, filed on Mar. 9, 2001. All of the above applications are hereby incorporated by reference herein.

TECHNICAL FIELD

The present invention relates to the confinement of a granular fluent material to form temporary barrier structures. More particularly, the present invention provides a fluent material confinement system configured to be easily deployable in low visibility conditions and/or rapidly joinable to adjacent fluent material confinement systems to form an extended structure.

BACKGROUND OF THE INVENTION

Flooding is one of the most common natural disasters. When a danger of a flood arises, sometimes the only possible measure to take to prevent loss of lives and/or damage to property is to construct a temporary barrier to divert or contain the floodwaters. These structures most commonly take the form of a wall constructed of sand-filled bags.

While sandbag walls may provide a measure of protection against the forces of floodwaters, they also have several drawbacks. For example, the construction of a sandbag wall may require a large number of people and an excessive amount of time to fill the bags and arrange them into a barrier structure. Also, a sandbag wall may have points of weakness, as the individual sandbags are generally merely stacked upon one another, rather than being attached to one another. Furthermore, the sandbags are generally not reusable. Thus, they may require an expensive and time-consuming disposal process, and new ones may need to be purchased after each emergency event in anticipation of future emergency events. Therefore, there remains a need for a rapidly deployable system for the construction of temporary barrier structures that is suitable for use in protecting property and lives during floods.

SUMMARY OF THE INVENTION

One aspect of the present invention provides a collapsible fluent material confinement system configured to receive a granular fluent material to form a temporary barrier structure. The fluent material confinement system includes a plurality of strips coupled to one another to form an array of collapsible cells, wherein the array of collapsible cells is configured to be movable between a collapsed configuration and an open configuration. The fluent material confinement system also includes a deployment indicator disposed on a selected strip, wherein the deployment indicator is configured to be effective in low visibility conditions to indicate to a user how to move the grid from the collapsed configuration to the open configuration.

Another aspect of the present invention provides a fluent material confinement system configured to receive a granular fluent solid to form a temporary barrier structure. The fluent material confinement system includes a plurality strips, the plurality of strips including a plurality of lengthwise strips and a plurality of widthwise strips coupled with each other to define a plurality of open cells, wherein each strip of the plurality of strips has opposing ends, and wherein each end has an edge. The fluent material confinement system also includes at least one connecting structure formed in an end of a selected strip. The connecting structure is configured to be coupled to a complementary connecting structure on an adjacent grid to connect the grid to the adjacent grid, and includes an aperture formed in the end of the selected strip at a location spaced from the edge of the end of the selected strip.

Yet another aspect of the present invention provides a method of forming a temporary barrier structure. The method includes providing a fluent material confinement system, the confinement system including a plurality of open cells, wherein the plurality of open cells includes a plurality of inner cells at least partially bordered by a plurality of outer border cells, filling the outer border cells with a first material, and filling the inner cells with a second, granular fluent material.

DETAILED DESCRIPTION OF THE PREFERRED EMBODIMENTS

Figure 1:
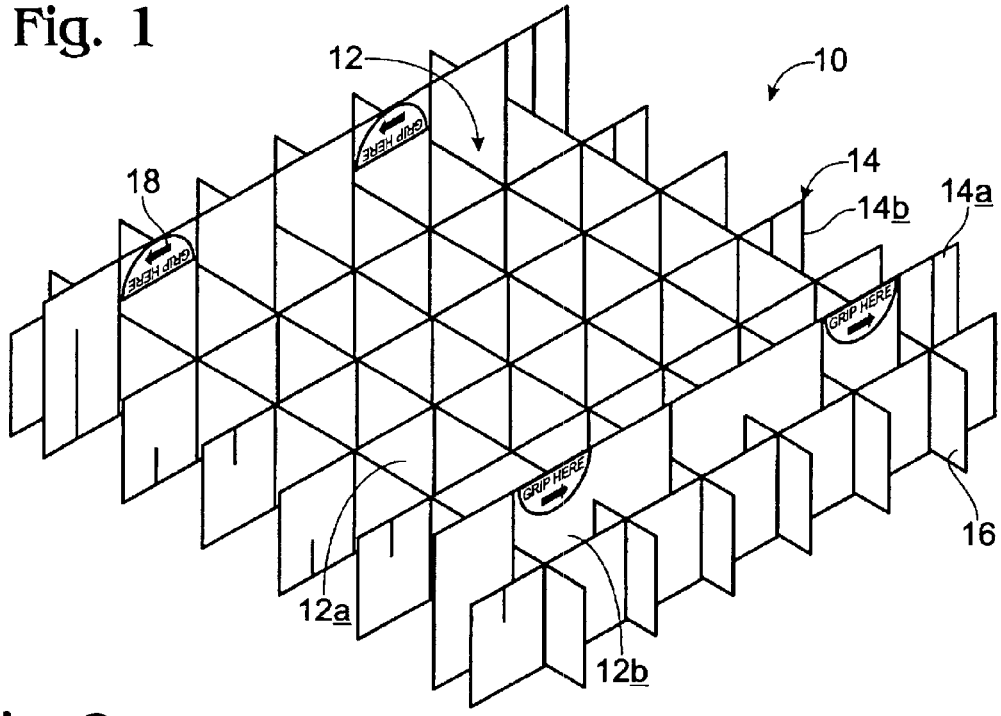
FIG. 1 is an isometric view of a first embodiment of a fluent material confinement system according to the present invention.

FIG. 1 shows, generally at 10, a first embodiment of a fluent material confinement system according to the present invention. Fluent material confinement system 10 is formed from a plurality of generally strip-shaped members coupled together in such a manner as to define an array of open-ended cells 12. The plurality of strip-shaped members includes a plurality of lengthwise strips, indicated generally at 14, and a plurality of widthwise strips 16. Lengthwise strips 14 may include strips of a first, greater width 14*a*, and strips of a second, lesser width 14*b*. The depicted arrangement of lengthwise strips 14 and widthwise strips 16 defines at least two different types of cells, interior cells 12*a* and exterior border cells 12*b*. Furthermore, the depicted arrangement of strips allows fluent material confinement system 10 to be movable between an open configuration (shown in FIG. 1) and at least one collapsed configuration, and may include one or more deployment indicators 18 to assist in the movement of the system from the collapsed configuration to the open configuration.

Cells 12 are configured to receive a granular fluent material, such as sand or gravel, and to prevent the fluent material from flowing or shifting a significant amount under horizontal or vertical loading. This results in the formation of a mechanically strong, sturdy structure. Thus, a plurality of fluent material confinement systems 10 may be stacked and/or arranged end-to-end and then filled with a granular fluent material to construct any number of different barrier structures. For example, fluent confinement grids have been used or proposed for use in the past as temporary roads across sandy soil, revetments for battlefields, or soil stabilization structures for stabilizing sloped terrain. Some of these and other possible uses are disclosed and described in more detail in U.S. Pat. No. 4,797,026 to Webster, which is hereby incorporated by reference.

Lengthwise strips 14 and widthwise strips 16 may have any suitable length. Typically, lengthwise strips 14 and widthwise strips 16 have a length in the range from three to six feet, and more typically approximately 4 feet, although they may have a length outside of these ranges as well. In the embodiment of FIG. 1, lengthwise strips 14 and widthwise strips 16 have the same length, giving fluent material confinement system 10 a generally square shape when in the open configuration.

Wider lengthwise strips 14*a* may have any suitable width relative to narrower lengthwise strips 14*b* and widthwise strips 16. For example, wider lengthwise strips 14*a* typically have a width of between ten and fourteen inches, and more typically approximately 12 inches, while narrower lengthwise strips 14*b* and widthwise strips 16 typically have a width of between six and ten inches and more typically approximately 8 inches. However, lengthwise strips 14 and widthwise strips 16 may have any other suitable dimensions. Furthermore, while fluent material confinement system 10 is shown as including eight lengthwise strips 14 and six widthwise strips 16, a fluent material confinement system according to the present invention may include any other suitable number of lengthwise strip and/or widthwise strips without departing from the scope of the present invention.

As mentioned above, a fluent material confinement system according to the present invention may configured to be attachable to other fluent material confinement systems in either a stacked or side-by-side arrangement. Thus, a fluent material confinement system according to the present invention may include any suitable connecting or supporting structures to enable a plurality of fluent material confinement systems to be connected in these manners. For example, fluent material confinement system 10 includes wider lengthwise strips 14*a*, which help to facilitate the stacking of a plurality of fluent material confinement systems 10 to form a taller structure. Typically, fluent material confinement systems 10 are stacked by placing a first fluent material confinement system on the ground in a right-side-up orientation (as shown in FIG. 1), and then stacking other fluent material confinement systems in an upside-down configuration on top of the first one. In this manner, the portion of wider lengthwise strips 14*a* that extends beyond the width of narrower lengthwise strips 14*b* extends into the confinement system positioned immediately below, and thus helps to reinforce the border cells of that confinement system.

In the depicted embodiment, each wider lengthwise strip 14*a* is positioned one lengthwise strip 14 away from the outer edge of fluent material confinement system 10. However, wider lengthwise strips 14*a* may have any other desired location within fluent material confinement system 10. Furthermore, while the depicted embodiment includes two wider lengthwise strips 14*a*, it will be appreciated that a fluent material confinement system according to the present invention may have either more or fewer wider lengthwise strips without departing from the scope of the present invention.

Figure 2:
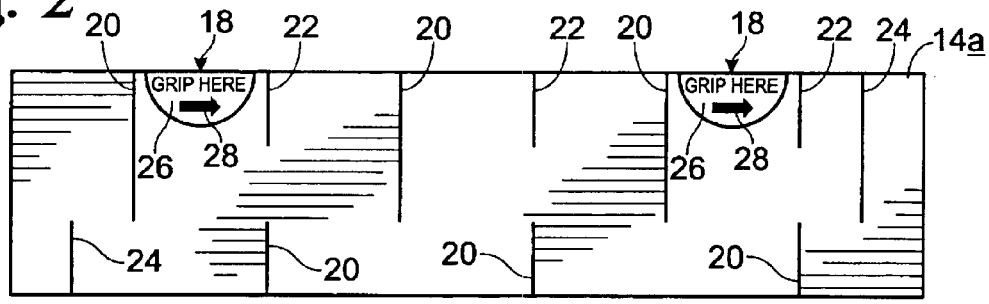
FIG. 2 is a front view of a wider lengthwise strip of the embodiment of FIG. 1.

FIG. 2 shows an exemplary wider lengthwise strip 14*a* in more detail. Wider lengthwise strip 14*a* includes a plurality of slots of several different types formed along the length of the strip. Each type of slot typically has a particular purpose. For example, some of the slots on wider lengthwise strip 14*a* are widthwise-strip-receiving slots 20 configured to accommodate the insertion of widthwise strips 16. Widthwise-strip-receiving slots 20 allow the lengthwise strips and widthwise strips to be interwoven to form fluent material confinement system 10. Widthwise-strip-receiving slots 20 are configured to nest within complementary lengthwise strip-receiving slots on widthwise strips 16, as described in more detail below.

Widthwise-strip-receiving slots are typically oriented perpendicular to the long dimension of wider lengthwise strip 14*a*. Widthwise-strip-receiving slots 20 typically extend sufficiently far into the width of wider lengthwise strip 14*a* so that the top edges of all widthwise strips 16 woven around a selected wider lengthwise strip are level with the top edges of narrower lengthwise strips 14*b*. Thus, widthwise-strip-receiving slots 20 that extend downwardly from the top edge of wider lengthwise strip 14*a* may extend further into the width of the wider lengthwise strip than the widthwise-strip-receiving slots that extend upwardly from the bottom edge of the wider lengthwise strip.

Widthwise-strip-receiving slots 20 may have any desired spacing. Typically, widthwise-strip-receiving slots 20 are spaced between four and twelve inches apart, and more typically approximately seven inches apart, but it will be appreciated that the widthwise-strip-receiving slots may also be spaced by a distance outside of these ranges. In the depicted embodiment, widthwise-strip-receiving slots 20 are spaced evenly, and alternately extend from the top edge and bottom edge of wider lengthwise strip 14*a*. The even spacing of widthwise-strip-receiving slots 20 creates cells of uniform dimensions, and may thus contribute to the regularity of the structural properties of fluent material confinement system 10. Furthermore, the alternating arrangement of widthwise-strip-receiving slots 20 allows the wider lengthwise strips and widthwise strips 16 to be interwoven, helping to hold fluent material confinement system 10 together during storage or transport. The interwoven structure of fluent material confinement system 10 also may allow the fluent material confinement system to be collapsed into at least two different collapsed configurations, as described in more detail below.

Besides widthwise-strip-receiving slots 20, wider lengthwise strip 14*a* also includes a plurality of stacking slots 22 to accommodate the stacking of a plurality of fluent material confinement systems 10. Stacking slots 22 are configured to receive the widthwise strips of a upper fluent material confinement system stacked on top of a lower fluent material confinement system. This helps to stabilize the upper fluent material confinement system, and also allows both the widthwise strips 16 and the narrower lengthwise strips 14*b* of the upper system to rest substantially fully against the widthwise strips and narrower lengthwise strips of the lower system when the systems are stacked.

Wider lengthwise strip 14*a* may also include a connecting slot 24 disposed at each of its ends for joining fluent material confinement system 10 to adjacent fluent material confinement systems in a side-by-side arrangement to form an extended structure. Connecting slot 24 is configured to be inserted into a complementary connecting slot 24 on an adjacent fluent material confinement system to join the two confinement systems together. However, a fluent material confinement system according to the present invention may utilize any other suitable connecting structure for connecting a plurality of fluent material confinement systems in a side-by-side manner. Other suitable connecting structures are described in more detail below.

Due to the regular or substantially symmetric shape of fluent material confinement system 10 when it is in the collapsed configurations, a user may have difficulty determining where best to grip the fluent material confinement system, and which direction to move the strip that is gripped to open the system, in poor visibility conditions. However, during emergency operations, such as the construction of a flood-retaining wall, time is generally of the essence, and any time wasted trying to determine how to deploy an emergency system such as the fluent material confinement system may jeopardize property and/or lives. Thus, fluent material confinement system 10 may include one or more deployment indicators 18 configured to be effective in low light conditions to instruct a user how to move the fluent material confinement system from at least one of the collapsed positions to the opened position.

A deployment indicator according to the present invention may enhance the operability of a fluent material confinement system in any desired manner. In the depicted embodiment, deployment indicators 18 indicate how fluent material confinement system 10 is to be moved from the closed position to the opened position via a visually enhanced instructional indicia disposed on wider lengthwise strips 14*a*. Deployment indicators 18 include a visibility enhancing background portion 26, and an indicating portion 28. Background portion 26 is typically formed from a reflective or fluorescent material to visually enhance the portions of fluent material confinement system 10 at which a user (or users) should hold the fluent material confinement system when deploying the system. Indicating portion 28 is at least partially within, and typically fully within, background portion 26, and is configured to stand out against the background portion so that the instructions contained within the indicating portion may be easily read and followed.

Indicating portion 28 may include any suitable indicia for indicating how fluent material confinement system 10 is to be moved to the open configuration. For example, in the depicted embodiment, indicating portion 28 has a legend indicating where a user is to grip fluent material confinement system 10, and also has an arrow indicating which direction the user is to move the fluent material confinement system to move the system to the opened position. While deployment indicator 18 is configured to visually enhance the portions of fluent material confinement system 10 that are to be gripped by a user, it will be appreciated that deployment indicator 18 may function in any other suitable manner. For example, the deployment indicator may include a series of raised bumps or to ridges to indicate where fluent material confinement system 10 is to be grasped via tactile enhancement.

Figure 3:
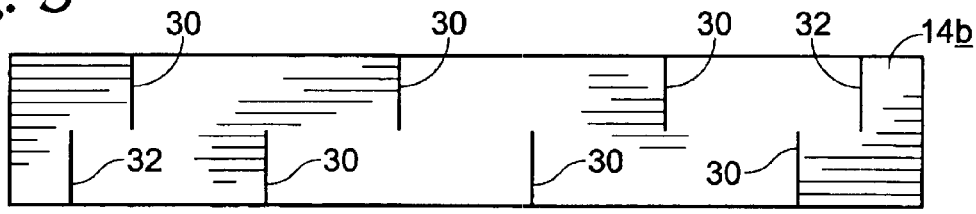
FIG. 3 is a front view of a narrower lengthwise strip of the embodiment of FIG. 1.

Narrower lengthwise strip 14*b* is shown in more detail in FIG. 3. Like wider lengthwise strips 14*a*, narrower lengthwise strips 14*b* include a plurality of slots of different types. For example, narrower lengthwise strips 14*b* include a plurality of widthwise-strip-receiving slots 30 that allow the narrower lengthwise strips to be coupled with widthwise strips 16. In the depicted embodiment, widthwise-strip-receiving slots 30 alternately extend from the top and bottom edges of narrower lengthwise strips 14*b*. This allows narrower lengthwise strips 14*b* to be interwoven with widthwise strips 16. Alternatively, all widthwise-strip-receiving slots 30 may extend from the same edge of narrower lengthwise strips 14*b* if desired. Narrower lengthwise strips 14*b* also may include one or more connecting slots 32 configured to be coupled to a complementary connecting slot on an adjacent fluent material confinement system to connect the systems in a side-by-side manner.

Figure 4:
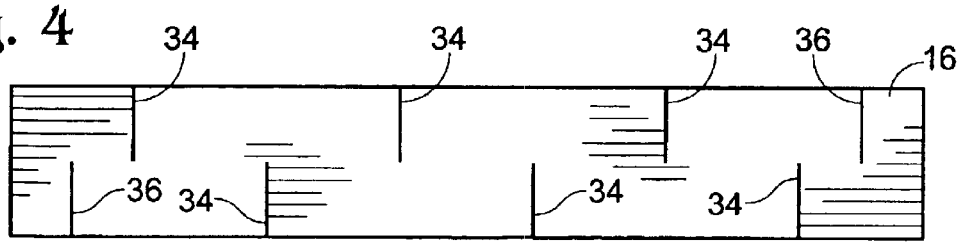
FIG. 4 is a front view of a widthwise strip of the embodiment of FIG. 1.

FIG. 4 shows an exemplary widthwise strip 16 in more detail. Each widthwise strip 16 includes a plurality of lengthwise-strip-receiving slots 34 disposed along the length of the widthwise strip. Lengthwise-strip-receiving slots 34 are configured to be joined with widthwise-strip-receiving slots 20 in wider lengthwise strip 14*a*, and with widthwise-strip-receiving slots 30 in narrower lengthwise strip 14*b*. In the depicted embodiment, lengthwise-strip-receiving slots 34 extend alternately from the top edge and bottom edge of each widthwise strip 16 so that the widthwise strips may be interwoven with the lengthwise strips. However, lengthwise-strip-receiving slots 34 may also extend from only one edge of widthwise strips 16 without departing from the scope of the present invention.

Besides lengthwise-strip-receiving slots 34, widthwise strips 16 also may include border cell slots 36 formed in the ends of each widthwise strip. Border cell slots 36 are configured to receive an outer lengthwise strip 14 to create border cells 12*b*. Border cell slots 36 may be spaced any desired distance from the adjacent lengthwise-strip-receiving slot 34. In the depicted embodiment, each border cell slot 36 is spaced approximately half the distance from the nearest lengthwise-strip-receiving slot 36. This creates border cells 12*b* of a smaller volume than interior cells 12*a*, and thus may make border cells more rigid for improved resistance to forces generated by static water pressures and wave impacts.

The various strips that form fluent material confinement system 10 may be made from any suitable materials. Suitable materials include strong, flexible plastics that are lightweight and damage resistant. Such materials reduce the weight and increase the durability of sand confinement grid system 10. The materials should also be relatively stiff to resist wave impacts, static water pressure and sand pressures, yet be sufficiently flexible to be interwoven. Furthermore, the materials are preferably transparent or translucent to allow the level of sand within the sand confinement grid system to be easily monitored. Some examples of suitable materials are PET (poly(ethylene terephthalate)), PETG (a copolyester of 1,4-cyclohexanedimethanol-modified poly(ethylene terephthalate)), PCTG (poly(1,4-cyclohexylene dimethylene terephthalate)), polyvinyl chloride, and polycarbonates such as bisphenol A polycarbonate. In contrast, softer, more flexible materials such as high density polyethylene may not have the necessary strength to withstand shifting under such conditions.

Many different additives may be used to modify the properties of these materials as needed. For example, UV absorbers may be added as either a starting material or as a coating on the finished product to increase the resistance of the material to UV degradation. Other possible additives include impact modifiers to increase impact resistance, and flexural modifiers to adjust the stiffness of the materials.

Figure 5:
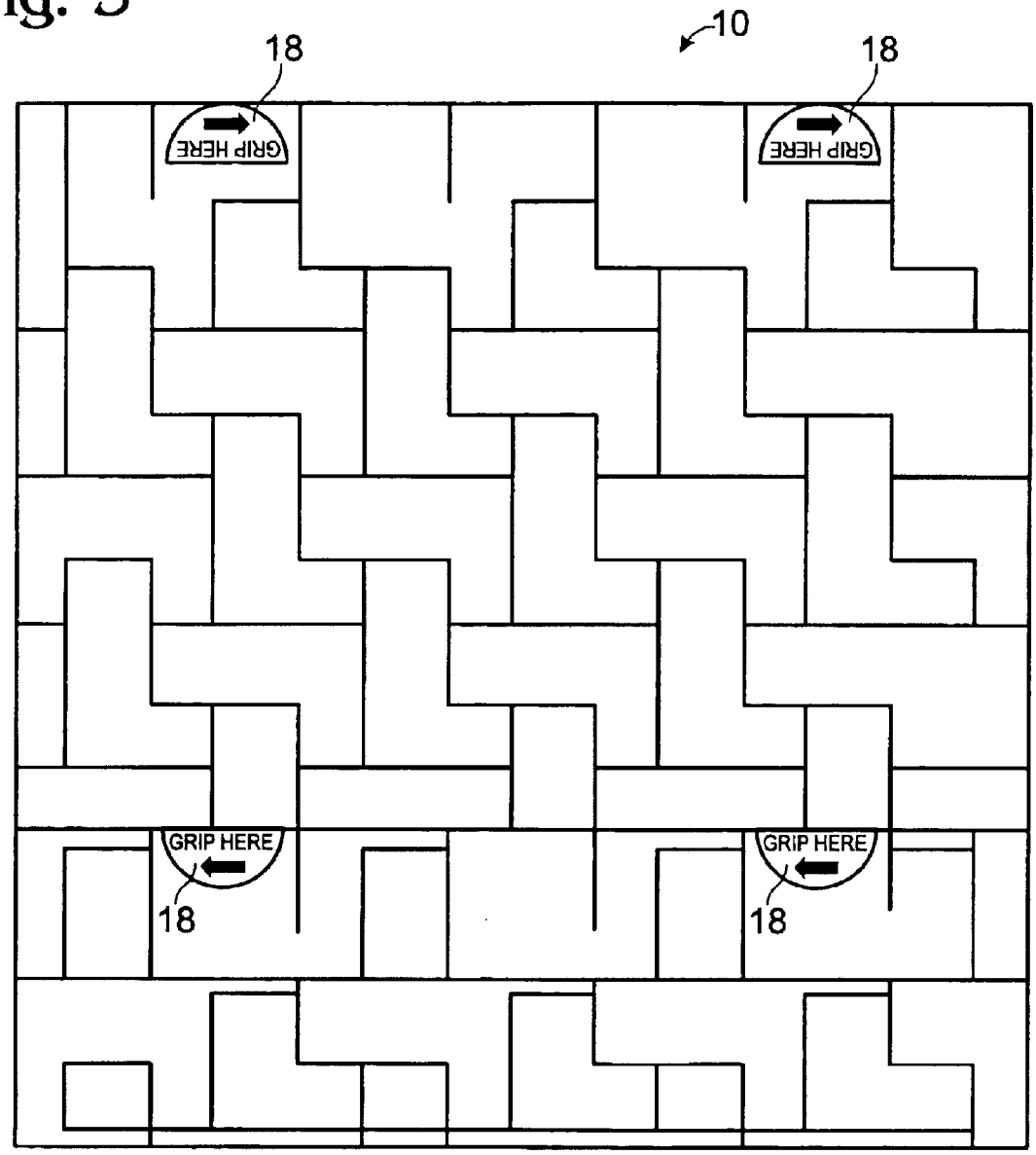
FIG. 5 is a perspective view of the embodiment of FIG. 1 in a first collapsed configuration.

As mentioned above, fluent material confinement system 10 is configured to be collapsible into at least one collapsed configuration for ease of storage and transport. FIG. 5 shows a first collapsed configuration of fluent material confinement system 10, in which the fluent material confinement system is collapsed down to a substantially flat sheet-like shape. In the configuration of FIG. 5, a large number of fluent material confinement systems 10 may be stacked in a relatively small amount of space for palletized storage. Furthermore, in this configuration, deployment indicators 18 are disposed on the top surface of fluent material confinement system 10, in plain view of users who are deploying the system. Thus, the users can easily determine where to grip and how to open fluent material confinement system 10 with only a quick glance at the system.

Figure 6:
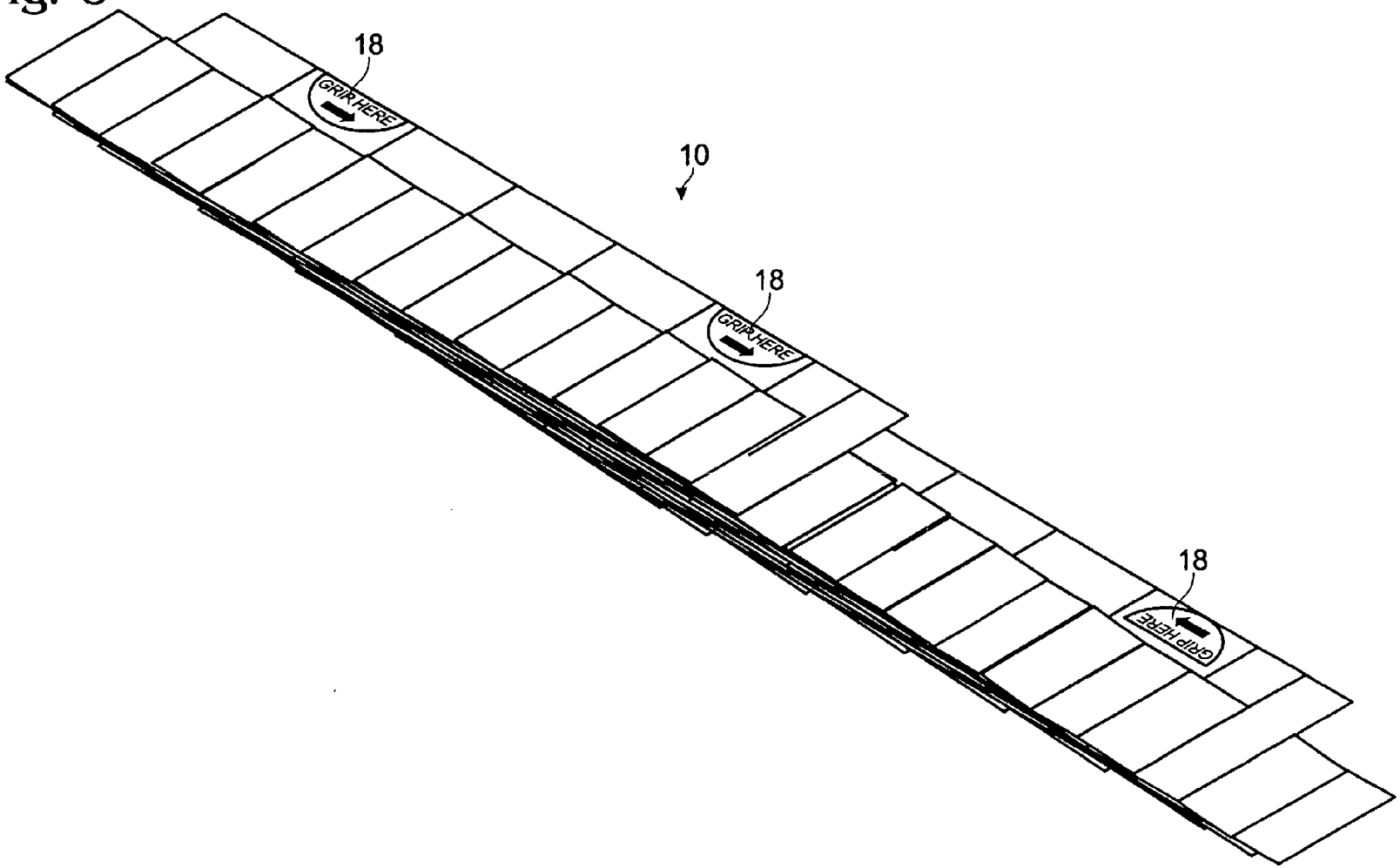
FIG. 6 is a perspective view of the embodiment of FIG. 1 in a second collapsed configuration.

FIG. 6 shows a second possible collapsed configuration for fluent material confinement system 10. In this configuration, fluent material confinement system 10 is collapsed into a narrow structure of the same width as wider lengthwise strips 14*a*. Just as with the collapsed configuration of FIG. 5, deployment indicators 18 may be configured to indicate where a user is to grip fluent material confinement system 10 to deploy the system, as well as the direction in which the system is to be moved for deployment.

Fluent material confinement system 10 occupies only a small amount of space when in the collapsed configuration of FIG. 6. Thus, a plurality of fluent material confinement systems 10 may be easily stored in a side-by-side and stacked arrangement when in the collapsed configuration of FIG. 6 for palletized storage.

Figure 7:
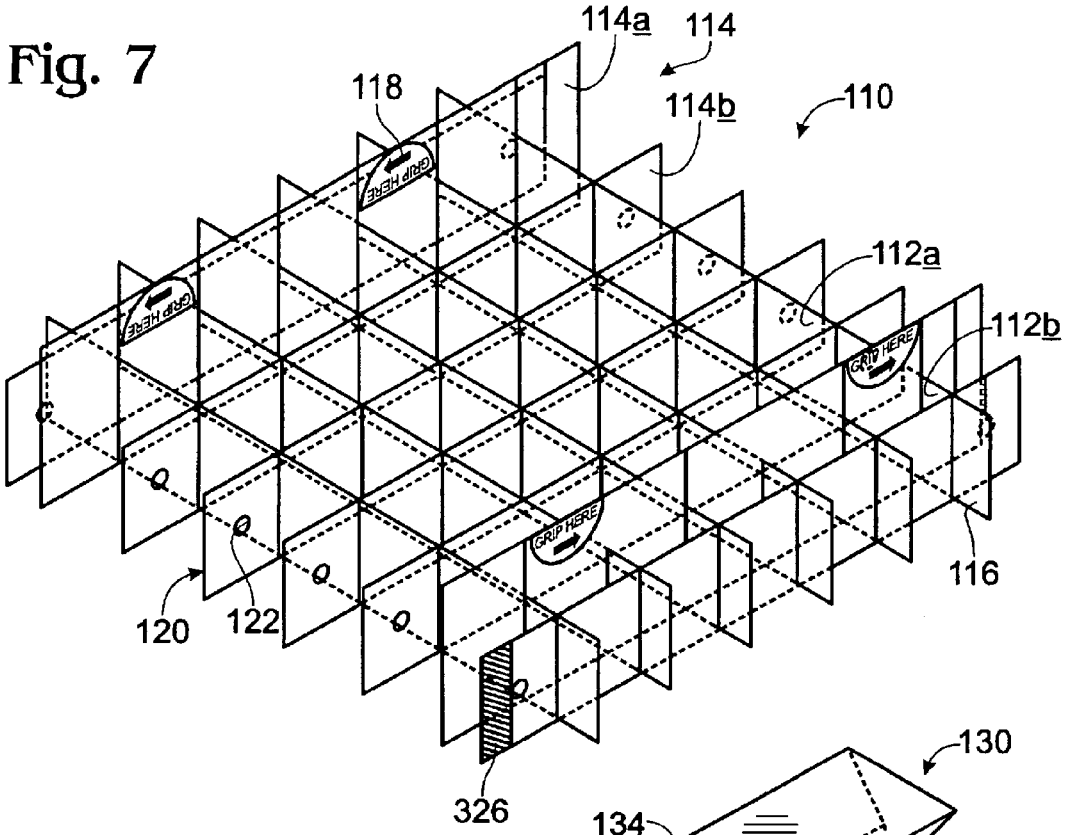
FIG. 7 is an isometric view demonstrating the deployment of the embodiment of FIG. 1.

FIG. 7 shows, generally at 110, a second embodiment of a fluent material confinement system according to the present invention. Fluent material confinement system 110 has many of the same features as fluent material confinement system 10. For example, fluent material confinement system 110 includes a plurality of interior cells 112*a* bordered by a plurality of border cells 112*b*. Interior cells 112*a* and exterior cells 112*b* are formed from an interconnected network of lengthwise strips 114 and widthwise strips 116. Lengthwise strips 114 may include both wider lengthwise strips 114*a*, and narrower lengthwise strips 114*b*. Furthermore, fluent material confinement system 110 may include a plurality of deployment indicators 118 configured to assist the deployment of the fluent material confinement system in low visibility conditions.

Fluent material confinement system 110 differs from fluent material confinement system 10, however, in that fluent material confinement system 110 employs a different connecting structure 120 for connecting adjacent fluent material confinement systems in a side-by-side manner. Connecting structure 120 includes an aperture 122 disposed at a location spaced from the edges of the end of narrower lengthwise strip 114*b*. Each aperture 122 is configured to be aligned with a complementary aperture on an adjacent fluent material confinement system, and to accept the insertion of a connector to join the two fluent material confinement systems together. In the depicted embodiment, each narrower lengthwise strip 114*b* includes two connecting structures 120. However, it will be appreciated that any other number of narrower lengthwise strips 114*b* may have connecting structures 120, that each (or any) narrower lengthwise strip may include only one connecting structure and that wider lengthwise strips 114*a* may also have similar connecting structures, without departing from the scope of the present invention.

Figure 8:
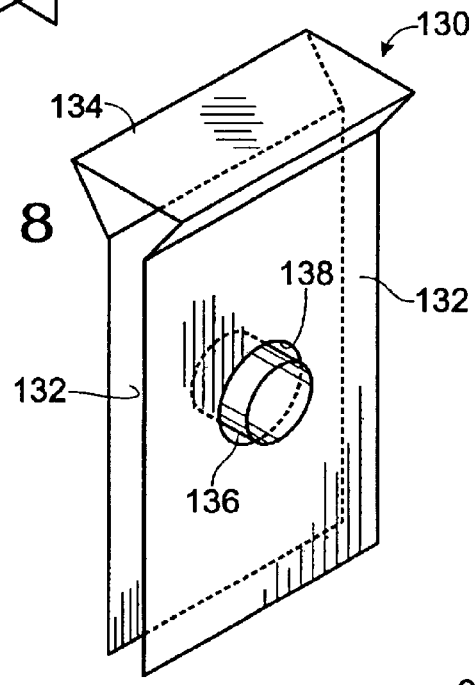
FIG. 8 is a perspective view of a plurality of fluent material confinement grids stacked, joined end-to-end, and filled with a granular fluent material to form a flood-retaining wall.

FIG. 8 shows, generally at 130, an example of a suitable connector for use with connecting structure 120. Connector 130 includes a pair of downwardly extending members 132 connected by a resilient top member 134. Downwardly extending members 132 are configured to pinch the ends of a pair of lengthwise strips 114 from adjacent fluent material confinement systems 110 together. Furthermore, one downwardly extending member 132 includes an extension 136 configured to fit through aperture 122. The other downwardly extending member 132 includes an aperture 138 through which extension 136 may extend. Connector 130 may be used to connect adjacent lengthwise strips 114 together by first aligning apertures 122 on the adjacent strips, and then placing connector 130 over the struts such that cylindrical extension 136 extends through both apertures 122 on lengthwise members 114.

Typically, cylindrical extension 136 has a circumference similar in shape and dimension to the inner circumference of apertures 122 to prevent the fluent material from flowing through apertures 122. In the depicted embodiment, extension 136 has a generally cylindrical shape configured to fit through the generally circular apertures 122 on lengthwise strips 114. However, it will be appreciated that extension 136 and apertures 122 may have any other suitable shape without departing from the scope of the present invention.

Figure 9:
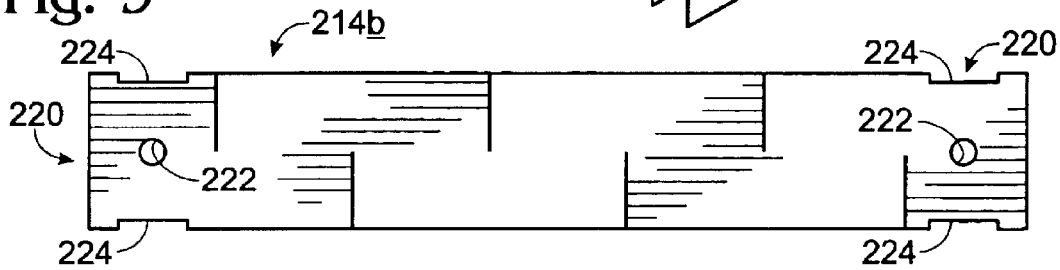
FIG. 9 is an isometric view of a fluent material confinement system according to a second embodiment of the present invention.

FIG. 9 shows an alternate configuration of a narrower lengthwise strip 214*b* suitable for use with the embodiment of FIG. 7. Narrower lengthwise strip 214*b* is similar to narrower lengthwise strip 114*b* in many respects. For example, narrower lengthwise strip 214*b* includes a connecting structures 220 formed at each end of the strip. Likewise, each connecting structures 220 includes an aperture 222 configured to be aligned with a complementary aperture on an adjacent fluent material confinement system and joined together with connector 130. However, connecting structures 220 also include recesses 224 formed in the top and bottom edges of narrower lengthwise strip 214*b* at each of its ends. Recesses 224 are configured to accommodate top member 134 of connector 130, and hold connector 130 in place when the connector is engaged with connecting structure 220. While recesses 224 are formed on two edges of each end of narrower lengthwise strip 214*b*, it will be appreciated that the recesses may also be formed only on one end, or only one recess may be formed in each end of the narrower lengthwise strip, without departing from the scope of the present invention.

Figure 10:
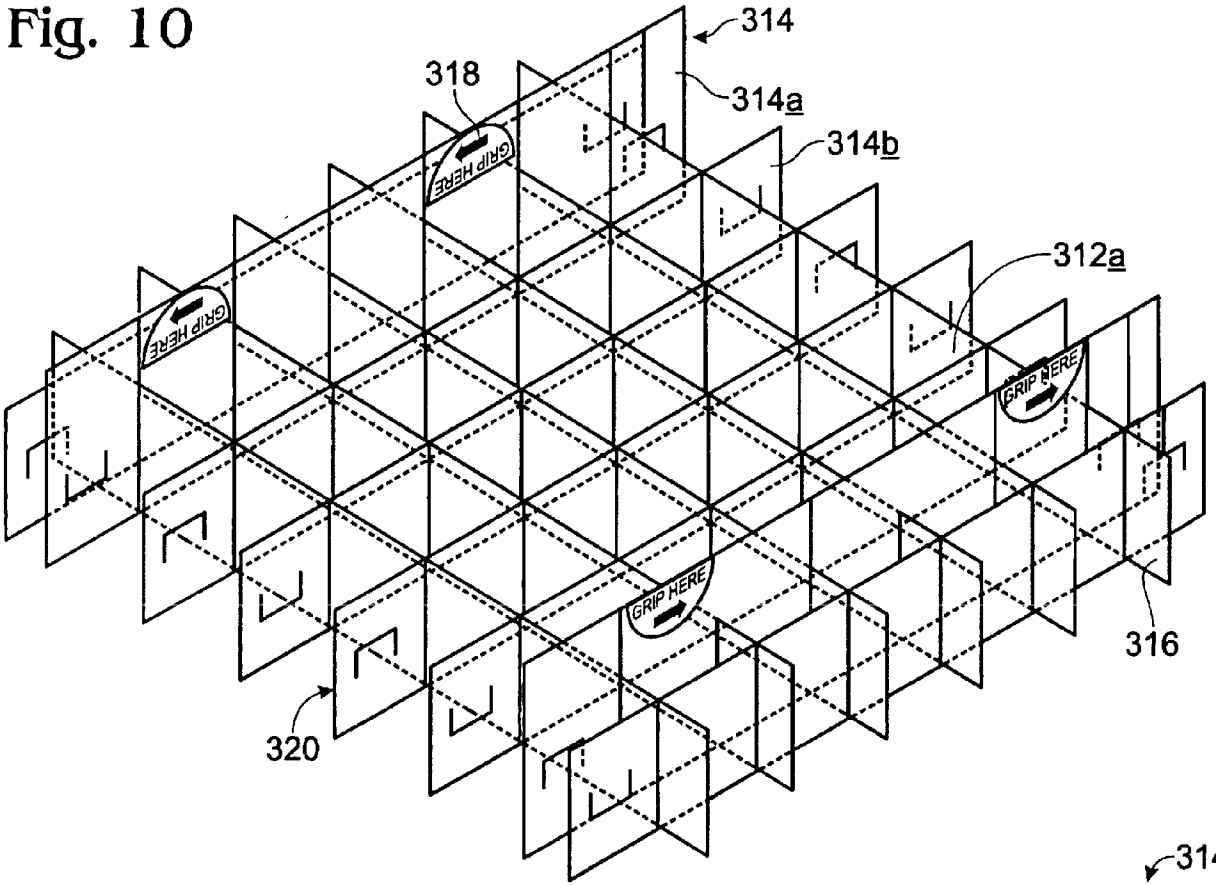
FIG. 10 is an isometric view of a connector suitable for connecting two fluent material confinement grids according to the embodiment of FIG. 9.

FIG. 10 shows, generally at 310, a third embodiment of a fluent material confinement system according to the present invention. Fluent material confinement system 310 has many of the same features as fluent material confinement systems 10 and 110. For example, fluent material confinement system 310 includes a plurality of interior cells 312*a* bordered by a plurality of border cells 312*b*. Interior cells 312*a* and exterior cells 312*b* are formed from an interconnected network of lengthwise strips 314 and widthwise strips 316. Lengthwise strips 314 may include both wider lengthwise strips 314*a* and narrower lengthwise strips 314*b*. Furthermore, fluent material confinement system 310 may include a plurality of deployment indicators 318 configured to assist the deployment of the fluent material confinement system in low visibility conditions.

Figure 11:
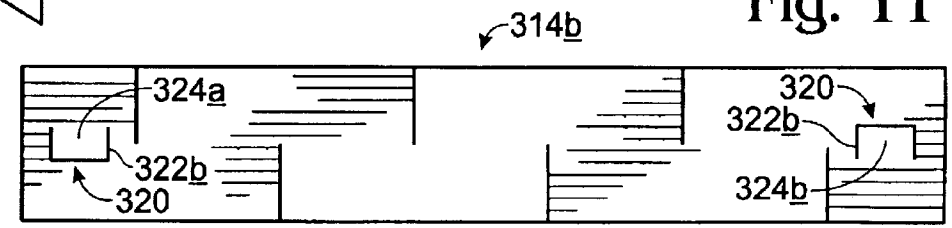
Fig. 11 is a front view of an alternate narrower lengthwise strip suitable for use with the embodiment of FIG. 9.

Fluent material confinement system 310 further includes connecting structures 320 disposed adjacent each end. Each connecting structure 320 includes a "U"-shaped aperture 322 spaced from the edges of the ends of narrower lengthwise strip 314*b*. Narrower lengthwise strip 314*b* is shown in more detail in FIG. 11. The "U"-shaped configuration of aperture 322 forms a tongue 324 surrounded on three sides by aperture 322. Also, the aperture 322*a* and tongue 324*a* structures on one end of narrower lengthwise strip 314*b* are oriented 180 degrees from the aperture 322*b* and tongue 324*b* structures on the other end of the narrower lengthwise strip. Thus, when two fluent material confinement systems 310 are arranged in a side-by-side manner, aperture 322*a* on one fluent material confinement system is disposed adjacent aperture 322*b* on the other fluent material confinement system. In this matter, tongue 324*a* on one fluent material confinement system can be inserted behind tongue 324*b* and through aperture 322*b* on the other fluent material confinement system to join the two systems together.

While each aperture 322 in the depicted embodiment has a generally "U"-shaped configuration, it will be appreciated that the aperture may have any other suitable configuration, such as a simple horizontal slot or a "V"-shaped configuration, without departing from the scope of the present invention.

Fluent material confinement system 310 (or systems 10 or 110) may also include an orientation indicator 326 disposed on a selected strip. Orientation indicator 326 helps a user to determine the orientation of fluent material confinement system 310 in inclement weather or other low visibility conditions. This may assist in the stacking of a plurality of fluent material confinement systems 310, as the orientation indicator of an upper fluent material confinement system in a stacked arrangement can be aligned with the orientation indicator of a lower fluent material confinement system to ensure the two fluent material confinement systems are in the correct orientation relative to one another.

Figure 12:
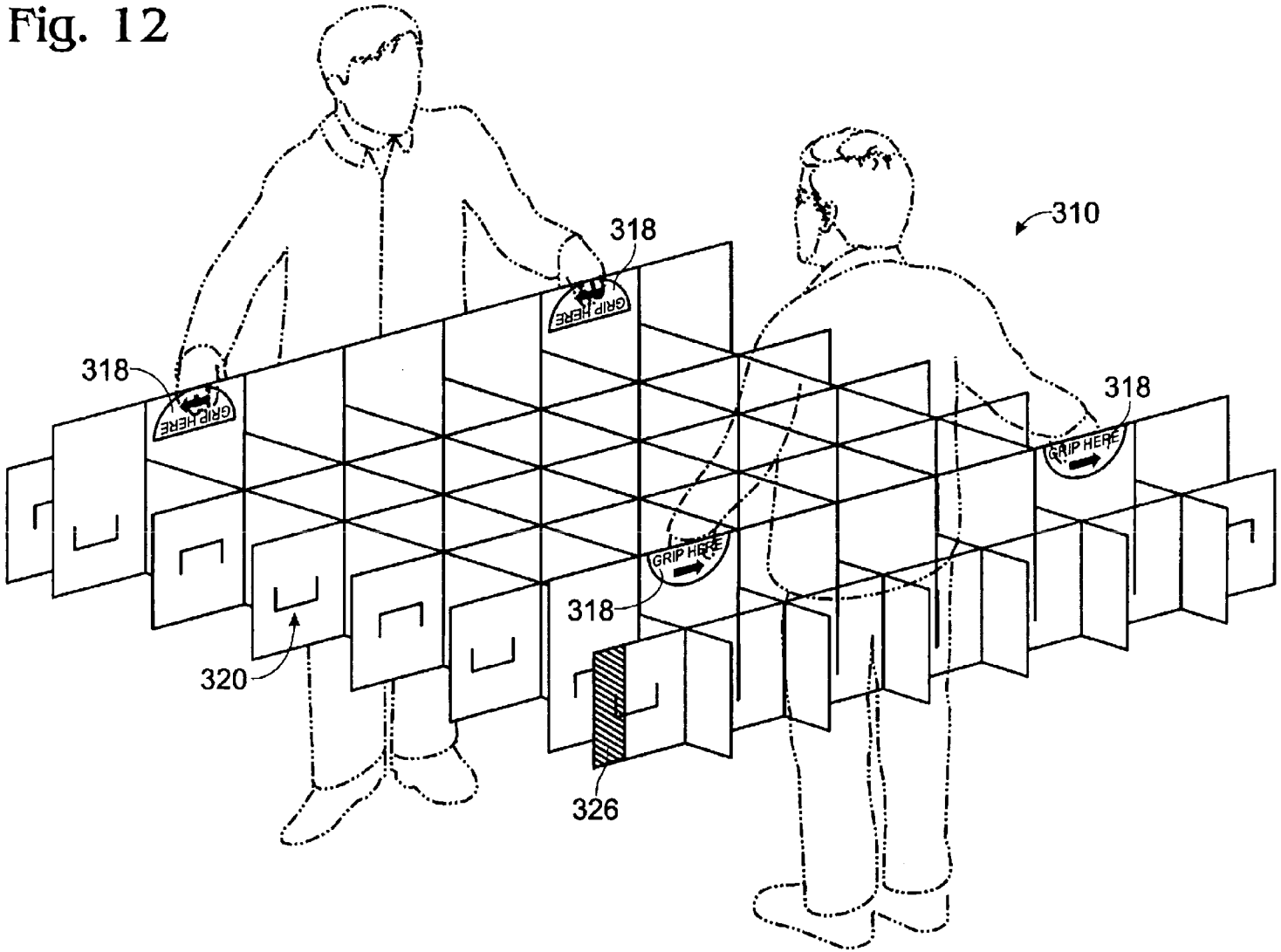
FIG. 12 is an isometric view of a fluent material confinement system according to a third embodiment of the present invention.

Typically, fluent material confinement systems 10, 110 or 310 are deployed by two users, as shown in FIG. 12 in the context of fluent confinement system 310. The users stand face to face on opposite sides of the collapsed fluent material confinement system 310, grip the fluent material confinement system where indicated, and simply pull in the direction indicated by deployment indicators 318. This causes fluent material confinement system 310 to quickly and easily convert to the open configuration. Then, fluent material confinement system 310 may be placed in a desired location, and another fluent material confinement system Opened for placement on top of or beside the first one to form an extended structure. The structures may then simply be filled with sand or other fluent material by a third person utilizing a suitable piece of equipment, such as a front loader, to complete the barrier structure. When the barrier structure is no longer needed, the temporary barrier structure may be disassembled by simply pulling the fluent material confinement systems off of one another, allowing the fluent material to fall out of the cells, and converting the fluent material confinement systems to a collapsed configuration for storage.

In some circumstances, a barrier structure of suitable strength may be constructed simply by filling an extended structure made of a plurality of fluent material confinement systems 310 with a single granular material, such as sand or local soils. However, in other circumstances, a stronger structure may be needed. In these circumstances, a different material may be added to the border cells to reinforce the outer portion of the extended structure. Examples of materials that may be added to the outer border cells to reinforce the extended structure include concrete or cement. The concrete or cement may have any suitable proportion of components. A cement mixture of approximately 20:1 has been proven to be particularly advantageous in reinforcing the border cells, as a cement of this mixture has good hardness properties, yet can be broken down for removal without undue effort.

A barrier with cement or concrete-filled outer border cells may be constructed in any suitable manner. One example of a suitable method of construction is as follows. First, a plurality of fluent material confinement systems 310 are stacked to a desired height and arranged to a desired length. As described above, the bottommost fluent material confinement system is positioned right side up, and other grid systems are positioned upside-down on top of the bottommost grid system. Next, interior cells 312*a* are covered with a suitable structure to prevent cement from entering the interior cells during the pouring process. Border cells 312*b* are left exposed. Examples of suitable structures for covering interior cells 312*a* include sheets of plywood or lightweight metal. Next, a cement mixture is poured into border cells 31 2*b*. The covering structures are then removed, and the fluent material is poured into interior cells 312*a*, typically using a front-loader or similar piece of heavy equipment. This method allows a solid barrier structure of a significant height and length to be rapidly constructed with the use of a small number of workers. If extra strength is desired, a second fluent material confinement system barrier may be build directly behind and against the first barrier to double the thickness of the protective barrier.

Figure 13:
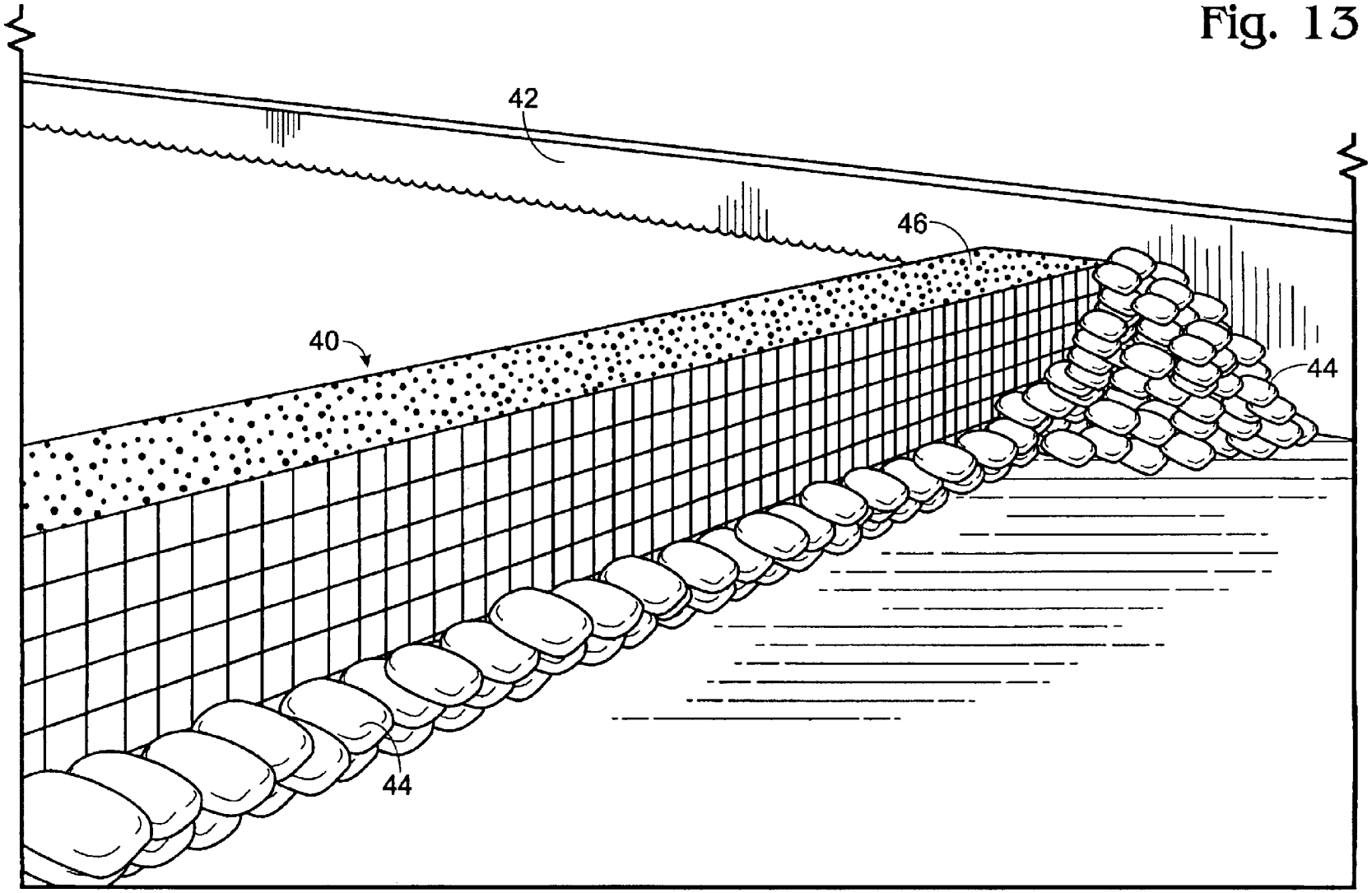
FIG. 13 is a front view of a narrower lengthwise strip of the embodiment of FIG. 12.

FIG. 13 shows a protective barrier constructed via another method according to the present invention. In some use environments, such as urban areas, a barrier 40 constructed of a plurality of fluent material confinement systems 10, 110 or 310 may need to be built against another fixed object 42, such as a wall of a building or a bridge piling. In this case, the region in which barrier structure 40 meets the fixed object 42 may need to be sealed or reinforced with other materials to prevent water from seeping around the edges of, or underneath the bottom of, the temporary barrier. One suitable method of reinforcing these edge regions is to surround the edge regions with material-filled bags 44. Bags 44 may contain sand, or any other suitable material, such as a cement mixture. Moreover, a cement mixture, typically a 20:1 mixture, may be poured into the space between the fixed object and the barrier to fill any space, left between the barrier. Finally, a line of bags 44 may also be placed along the bottom of barrier structure 40 to prevent water from seeping underneath the bottom of barrier structure 40. The fluent material 46 contained within barrier structure 40 provides the structural integrity for the wall, while sandbags 44 seal the seams between the barrier structure and other surrounding structures.

The disclosure set forth above encompasses multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious and directed to one of the inventions. These claims may refer to "an" element or "a first" element or the equivalent thereof;

such claims should be understood to include incorporation of one or more such elements, neither requiring nor excluding two or more such elements. Inventions embodied in other combinations and subcombinations of features, functions, elements, and/or properties may be claimed through amendment of the present claims or through presentation of new claims in this or a related application. Such claims, whether directed to a different invention or to the same invention, and whether broader, narrower, equal, or different in scope to the original claims, also are regarded as included within the subject matter of the inventions of the present disclosure.

I claim:

1. A fluent material confinement system configured to receive a granular fluent solid to form a temporary barrier structure, the fluent material confinement system comprising:

a plurality strips, the plurality of strips including a plurality of lengthwise strips and a plurality of widthwise strips coupled with each other to define a plurality of open cells, wherein each step of the plurality of strips has opposing ends, and wherein each end has a perimeter; and at least one connecting structure formed in an end of a selected strip, the connecting structure being configured to be coupled to a complementary connecting structure on an adjacent fluent material confinement system to connect the fluent material confinement system to the adjacent fluent material confinement system, wherein the connecting structure includes a tongue formed in the end of the selected strip at a location spaced from the perimeter of the end of the selected strip, wherein the tongue is formed from a slot formed in the end of the selected strip at a location spaced from the perimeter of the end of the selected strip, and wherein the tongue is configured to fit within a complementary slot on the adjacent fluent material confinement system.

2. The fluent material confinement system of claim 1, wherein the slot has a generally "U"-shaped configuration.

3. The fluent material confinement system of claim 1, wherein each lengthwise strip has opposing ends, and wherein each end of each lengthwise strip includes a connecting structure.

4. The fluent material confinement system of claim 1, wherein the plurality of lengthwise strips are coupled to the plurality of widthwise strips in such a manner that the fluent material confinement system is movable between an open configuration and a collapsed configuration, further comprising a deployment indicator disposed on a selected strip, wherein the deployment indicator is configured to be effective in low visibility conditions to indicate to a user how to move the grid between the open configuration and the collapsed configuration.

5. The fluent material confinement system of claim 4, wherein each strip of the plurality of strips has a width, wherein at least one selected strip has a greater width than the other strips, and wherein the deployment indicator is disposed on the selected strip.

6. The fluent material confinement system of claim 5, wherein two selected strips have greater widths than the other strips of the plurality of strips, and where each of the selected strips includes a deployment indicator.

7. The fluent material confinement system of claim 4, wherein the deployment indicator is configured to visually enhance a portion of the selected strip.

8. The fluent material confinement system of claim 7, wherein the deployment indicator includes a reflective portion.

9. The fluent material confinement system of claim 7, wherein the deployment indicator includes a directionally indicating portion disposed at least partially within the reflective portion.

10. The fluent material confinement system of claim 7, wherein the deployment indicator includes an indication of where to grip the selected strip for deployment of the fluent material confinement system.

11. The fluent material confinement system of claim 1, further comprising an orientation indicator disposed on a selected strip of the plurality of strips, wherein the orientation indicator is configured to be effective in low visibility conditions to indicate to a user an orientation of the fluent material confinement system.

12. The fluent material confinement system of claim 11, wherein each strip of the plurality of strips has a width, wherein at least one selected strip has a greater width than the other strips, and wherein the deployment indicator is disposed on the selected strip.

13. The fluent material confinement system of claim 1, wherein the plurality of strips are formed at least partially from at least material selected from the group consisting of PET (poly(ethylene terephthalate)), PETG (a copolyester of 1,4-cyclohexanedimethanol-modified poly(ethylene terephthalate), PCTG (poly(1,4-cyclohexanedimethanol terephthalate)), polyvinyl chloride, polycarbonates, and bisphenol A polycarbonate.

14. A fluent material confinement system configured to receive a granular fluent solid to form a temporary barrier structure, the fluent material confinement system comprising:

a plurality strips, the plurality of strips including a plurality of lengthwise strips and a plurality of widthwise strips coupled with each other to define a plurality of open cells, wherein each strip of the plurality of strips has opposing ends, and wherein each end has a perimeter;

at least one connecting structure formed in an end of a selected strip, the connecting structure being configured to be coupled to a complementary connecting structure on an adjacent fluent material confinement system to connect the fluent material confinement system to the adjacent fluent material confinement system, wherein the connecting structure includes a tongue formed in the end of the selected strip at a location spaced from the perimeter of the end of the selected strip, wherein the tongue is formed from a slot formed in the end of the selected strip at a location spaced from the perimeter of the end of the selected strip, and wherein the tongue is configured to fit within a complementary slot on the adjacent fluent material confinement system; and a deployment indicator disposed on a selected strip, wherein the deployment indicator is configured to be effective in low visibility conditions to indicate to a user how to move the grid between the open configuration and the collapsed configuration.

15. The fluent material confinement system of claim 14, the fluent material confinement system having a corner, wherein the orientation indicator is located at the corner of the fluent material confinement system.

16. The fluent material confinement system of claim 14, wherein the fluent material confinement system is a first fluent material confinement system, and wherein the orientation indicator is configured to be aligned with an orientation indicator of a second fluent material confinement system when the second fluent material confinement system is stacked on the first fluent material confinement system.

17. A fluent material confinement system configured to receive a granular fluent solid to form a temporary barrier structure, the fluent material confinement system comprising:

a plurality strips, the plurality of strips including a plurality of lengthwise strips and a plurality of widthwise strips coupled with each other to define a plurality of open cells, wherein each strip of the plurality of strips has opposing ends, and wherein each end has a perimeter;

at least one connecting structure formed in an end of a selected strip, the connecting structure being configured to be coupled to a complementary connecting structure on an adjacent fluent material confinement system to connect the fluent material confinement system to the adjacent fluent material confinement system, wherein the connecting structure includes a tongue formed in the end of the selected strip at a location spaced from the perimeter of the end of the selected strip, wherein the tongue is formed from a slot formed in the end of the selected strip at a location spaced from the perimeter of the end of the selected strip, and wherein the tongue is configured to fit within a complementary slot on the adjacent fluent material confinement system; and an orientation indicator disposed on a selected strip of the plurality of strips, wherein the orientation indicator is configured to be effective in low visibility conditions to indicate to a user an orientation of the fluent material confinement system.

* * * * *